US007011243B2

(12) United States Patent
Mochizuki

(10) Patent No.: US 7,011,243 B2
(45) Date of Patent: Mar. 14, 2006

(54) STAPLER APPARATUS

(75) Inventor: Naoto Mochizuki, Yamanishi Prefecture (JP)

(73) Assignees: ACCO Brands USA LLC, Lincolnshire, IL (US); NISCA Corporation, Yamanashi-Ken (JP)

( * ) Notice: Subject to any disclaimer, the term of this patent is extended or adjusted under 35 U.S.C. 154(b) by 0 days.

(21) Appl. No.: 10/477,326

(22) PCT Filed: May 31, 2002

(86) PCT No.: PCT/IB02/01936

§ 371 (c)(1),
(2), (4) Date: Nov. 11, 2003

(87) PCT Pub. No.: WO03/015993

PCT Pub. Date: Feb. 27, 2003

(65) Prior Publication Data

US 2004/0164119 A1 Aug. 26, 2004

(30) Foreign Application Priority Data

May 31, 2001 (JP) ..... 2001-165888

(51) Int. Cl.
*B25C 5/16* (2006.01)

(52) U.S. Cl. ..... 227/131; 227/129; 227/137; 227/155

(58) Field of Classification Search ..... 227/81, 227/82, 87, 129, 131, 137, 155, 156
See application file for complete search history.

(56) References Cited

U.S. PATENT DOCUMENTS

| | | | | |
|---|---|---|---|---|
| 4,186,863 | A * | 2/1980 | Yunoki | 227/131 |
| 4,199,095 | A * | 4/1980 | Yamanoi | 227/125 |
| 4,726,505 | A * | 2/1988 | Okazaki | 227/132 |
| 4,844,319 | A | 7/1989 | Kurosawa | |
| 5,230,457 | A | 7/1993 | Hiroi et al. | |
| 5,413,266 | A * | 5/1995 | Jairam | 227/129 |
| 5,495,975 | A * | 3/1996 | Jairam et al. | 227/123 |
| 5,862,971 | A * | 1/1999 | Ebner | 227/155 |
| 6,036,074 | A | 3/2000 | Manabe | |

* cited by examiner

*Primary Examiner*—Louis K. Huynh
*Assistant Examiner*—Nathaniel Chukwurah
(74) *Attorney, Agent, or Firm*—Michael Best & Friedrich LLP

(57) ABSTRACT

A stapler apparatus includes right and left side frames each opposing the other, a reciprocally moving staple driving member arranged between the side frames, a cam member interlocked to the staple driving member to reciprocally move the staple driving member and a drive motor interlocked to the cam member. The drive motor, the cam member and the staple driving member are arranged in order between the left and right frames.

10 Claims, 12 Drawing Sheets

15 = Holder member
16b = Second mounting wall
16c = Bulkhead
21 = Drive motor
23 = First cam member
24 = Second cam member
60 = Driver unit 15 = Holder member
16b = Second mounting wall
16c = Bulkhead
21 = Drive motor
23 = First cam member
24 = Second cam member
60 = Driver unit

STAPLER APPARATUS

DETAILED DESCRIPTION OF THE INVENTION

1. Field of Application

The present invention relates to a stapler apparatus for stapling a bundle of predetermined sheets put thereon with motor-driven staple driving means.

2. Prior Art

A previous stapler apparatus for automatically stapling a sheet bundle with special staples has staple driving means on either of a fixed frame and a movable frame closing to or separating from each other and staple bending means on the other. The staple driving means is structured so that the linear staple is bent to a U-shape before being driven into the sheet bundle, and the staple bending means bends both ends of the staple passed through the sheet bundle.

The staple driving means has a plate-shaped staple driving member mounted reciprocally movable on either of the fixed frame and the movable frame. The staple driving member is reciprocally moved by rotating cams such as eccentric cams. The eccentric cams are interlocked to a drive motor so that the staple driving member can be automatically moved reciprocally. The staple driving member bends the linear staple to the U-shape to drive into the sheet bundle as moving reciprocally. Such a structure of the staple driving means is proposed in, for example, Japanese Laid Open Patent Tokkai Hei 9-169006. Another known structure is that a first step of plate-shaped staple member bends linear staples to a U-shape before a second step of stroking drives the U-shaped staples into the sheet bundle. Further known structure is that a step bends staples to a U-shape before the next step drives the staple into the sheet bundle.

PROBLEMS TO BE SOLVED BY THE INVENTION

However, the staple driving means in any of the above-mentioned structure includes the following constructions of mounting means on apparatus frame and driving means for driving it. The apparatus frame is provided with a right and left side frames of cross-section such as U-shape. The side frames have a staple driving member mounted therebetween reciprocally movable upward and downward. The right and left side frames have paired rotating cams for driving arranged to project there outside. The apparatus frame has swinging arms engaged with the rotating cams disposed there outside as supported movably by shaft. The paired arms have ends interlocked with the staple driving member. The rotating cams have rotating shafts interlocked with a drive motor via deceleration gears. Such previous stapler apparatuses having a drive system for the staple driving member, including the rotating cams and the swinging arms, arranged outside the apparatus frame, are disadvantageous in safety concern that in maintenance work such as replacement of the staples or for staple jamming, an operator may contact the drive system. For the reason, it must be unavoidably needed to provide a cover for encasing the drive system and other safety designs. It is also disadvantageous in that the apparatus becomes large in size and high in costs of components. These result from the facts that the right and left paired side frames on the apparatus frame need a certain space therebetween to build the staple driving member at a center thereof and that the apparatus frame has the drive system projected there out.

In view of solving the foregoing problems of the previous arts, it is an object of the present invention to provide a stapler apparatus that can be made smaller and higher in safe maintenance and can reduce the noise of operation. The present invention was made on the basis of the knowledge that the staple driving means and the rotating cams for driving it and the drive motor should be arranged in the apparatus frame having the right and left paired side frames.

MEANS TO SOLVE THE PROBLEMS

To solve the problems mentioned above, the stapler apparatus of the present invention comprises right and left side frames each opposing the other, a reciprocally moving staple driving member arranged between the side frames, a cam member interlocked to the staple driving member to reciprocally move the staple driving member and a drive motor interlocked to the cam member, wherein the drive motor, the cam member and the staple driving member are arranged in order between the left and right frames.

According to the invention, no members are exposed out of the frame. Therefore, the members do not need any cover, and the apparatus is excellently high in safety. The right and left side frames have the drive motor, the cam members, and the staple driving member arranged in order therebetween. This allows for arranging them in line, making the apparatus compact.

In one embodiment, the present invention is characterized in that the right and left paired side frames have holder members disposed there between and that the holder members have said drive motor and said cam members installed thereon.

According to the present invention, the holder members mounted in between the right and left side frames have the drive motor and the cam members fixed thereon. This is advantageous in that a rotational torque of the drive motor can be transmitted to the cam members without shaking of a rotational center thereof.

In another aspect of the invention, the holder members have supports for supporting rotating shafts on the cam members and supports for supporting peripheries of the cam members disposed thereon, and the cam members are rotatably supported at the two supports.

According to the invention, as the cam members are rotatably supported at the rotating shafts at the two points, including the supports for supporting rotating shafts and the supports for supporting peripheries, the rotational centers cannot be shaken during driving and deviated even if external impacts are applied thereto.

In yet another aspect of the invention, the cam members are formed of paired rotating cams, and rotating shafts of the respective rotating cams are arranged in parallel with a direction virtually orthogonalizing a plane formed by reciprocal movement locus of the staple driving member.

According to the invention, driving can be made smooth as the reciprocal movement of the staple driving member can be made at the two positions at the same time. As the rotating shafts of the respective rotating cams are arranged in parallel with a direction virtually orthogonalizing the plane formed by reciprocal movement locus of the staple driving member, the rotational movements of the cams can be directly converted to linear movement for the staple driving member, thus providing high driving transmission efficiency.

In yet a further aspect of the invention, the paired rotating cams have cam faces displacing in a reciprocal movement direction of the staple driving member with rotation, and the cam faces are fitted with the staple driving member.

According to the invention, fitting of the cam faces with the staple driving member features that the interlocking structure can be made simple and smooth in operation.

In another aspect of the invention, the holder housing has a mounting wall for the drive motor and a mounting wall for the cam members therein, and the two mounting walls contain gears for transmitting drive force from the drive motor to the cam members in therebetween.

According to the invention, the structure that the holder housing has a mounting wall for the drive motor and a mounting wall for the cam members therein, and the two mounting walls contain gears for transmitting drive force from the drive motor to the cam members in therebetween, can prevent the apparatus from being damaged by external impacts and from being corroded at gear teeth of the gears in surrounding atmosphere. The apparatus will not leak noise in driving, providing excellent quiet operation.

In one embodiment, an anvil cam and a clinch cam are added to the stapler apparatus.

According to the invention, the anvil cam and the clinch cam are integrated with the cam members fitted into the holder housing at the two points. This does not only provide secure and stable operation for the staple driving member, but also for the anvil unit and the clincher unit.

EMBODIMENTS

The following describes an embodiment of the stapler apparatus of the present invention by reference to the accompanying drawings. FIG. 1 is a perspective view of an overall structure of a stapler apparatus of the present invention. FIG. 2 is a side view of the stapler apparatus shown in FIG. 1. FIG. 3 is a perspective view of main units of the stapler apparatus, including a driver unit and an anvil unit. FIG. 4 is a perspective view of main parts of the driver unit, FIG. 5 is a perspective exploded view of the driver unit, FIG. 6 is a perspective view of main parts of an embodiment of a supporting structure for cam members, and FIG. 7 is a cross-sectional view of the supporting structure in FIG. 6.

The stapler apparatus 10 in the embodiment, as shown in FIGS. 1 and 2, has a U-shaped apparatus frame 11 formed of a right and left paired side frames 11*a* and 11*b* and a bottom plate 11*c* as a profile therefore, a driver unit 20 built in the apparatus frame 11 as a staple driving member, an anvil unit 30 supported rotatably on the apparatus frame 11 as a bending member, and a staple supply unit 40 arranged detachably at a rear of the apparatus frame 11. The driver unit 20 is structured so as to separate staples one by one from the sheet-like staple band having many staples interlocked together like a band, to form the separated staples to a U-shape, and to drive in thickness direction the staples into the sheet bundle fed in the anvil unit 30 positioned above. The anvil unit 30 arranged against the driver unit 20, on the other hand, is structured so as to receive both ends of the staple driven in the sheet bundle before to bend the both ends inward, thereby finally stapling the sheet bundle.

The apparatus frame 11 has a mount 12 disposed for mounting a staple supply unit 40 at a rear thereof and has a sheet table 13 for putting the sheet bundle at a front thereof. The apparatus frame 11 also has a driver unit 20 for driving sheet-like staples fed from the staple supply unit 40 therein and has a drive motor for driving the driver unit 20 therein. The staple supply unit 40 has a cassette 41 containing the staples interlocked together like a sheet and has a holder 42 for containing the cassette 41, being detachably mounted on a mount 12 of the apparatus frame 11. The driver unit 20 is described below in detail by reference to FIGS. 3 through 5. The driver unit 20 comprises a drive motor 21, deceleration gears 22, a first cam member 23, a second cam member 24, and a driver 60. The deceleration gears 22, the first cam member 23 and the second cam member 24 are assembled in a holder housing 15 partitioned by a bulkhead 16*c* and are rotatably supported by a first mounting wall 16*a*, a second mounting wall 16*b*, and the bulkhead 16*c* of the holder housing 15. The drive motor 21 is made up of a single dc motor an output gear 21*a* of which has the deceleration gears 22 interlocked thereto. The deceleration gears 22 comprise a first deceleration gear 22*a*, a second deceleration gear 22*b*, a third deceleration gear 22*c*, a fourth deceleration gear 22*d*, a fifth deceleration gear 22*e*, a sixth deceleration gear 22*f*, and a seventh deceleration gear 22*g* as looked outward from the output gear 21*a*. The sixth deceleration gear 22*f* is a final gear stage to swing the first cam member 23. The seventh deceleration gear 22*g* is a final gear stage to swing the second cam member 24.

Both the first cam member 23 and the second cam member 24 are formed of the same member and arranged in parallel with the drive motor 21. The first cam member 23 and the second cam member 24 are made up of drive gears 23*a* and 24*a* that have the torque to rotate in different directions by the sixth deceleration gear 22*f* and the seventh deceleration gear 22*g*, eccentric cams 23*c* and 24*c* that are fitted via shafts 23*b* and 24*b*, and rotating cams 23*e* and 24*e* for reciprocally moving the driver 60, respectively. The eccentric cams 23*c* and 24*c* are shaped virtually semicircle, peripheries of which drives the anvil unit 30 to swing. The eccentric cams 23*c* and 24*c* also have clincher swinging shafts 23*d* and 24*d* projected there out for swinging a clincher unit disposed inside the anvil unit 30, respectively. The rotating cams 23*e* and 24*e*, on the other hand, are rotatably supported by the eccentric cams 23*c* and 24*c* and engaging pins 23*f* and 24*f* and are rotated in synchronization with the drive gears 23*a* and 24*a*. The rotating cams 23*e* and 24*e* have driver swinging pins 23*g* and 24*g* arranged symmetrically in a standing condition at positions separated from centers thereof on front surfaces thereof, respectively. The driver swinging pins 23*g* and 24*g* are engaged with slits 62*a* and 62*b* opened on a driver body 61, respectively. As described above, the first cam member 23 and the second cam member 24 operate the anvil unit 30, the clincher unit 50, and the driver 60 at the same time.

The drive motor 21, the deceleration gears 22, the first cam member 23, and the second cam member 24 that form the driver unit 20, as shown in FIG. 5, are contained in the holder housing 15 as a casing. The holder housing 15 is made up like a box of a first mounting wall 16*a* having the drive motor 21 mounted thereon, a second mounting wall 16*b* having the rotating cams 23*e* and 24*e* fitted rotatably therewith, a bulkhead 16*c* disposed in between the first mounting wall 16*a* and the second mounting wall 16*b*, and a first housing room 15*a* and a second housing room 15*b* partitioned right and left by the bulkhead 16*c*.

The one first housing room 15*a* has deceleration gears 22 extended from the output gear 21*a* on the drive motor 21 and drive gears 23*a* and 24*a* arranged rotatably. The other second housing room 15*b* has a first cam member 23 and a second cam member 24 extended toward the driver 60 arranged rotatably. The bulkhead 16*c* that is one wall of the second housing room 15*b* has shaft holes 23*i* and 24*i* for passing shafts 23*b* and 24*b* disposed thereon. The second mounting wall 16*b* that is the other wall, as shown in FIGS. 6 and 7, has a concave 18 formed thereon which has the rotating cams 23*e* and 24*e* fitted therein rotatably. The shaft holes 23*i* and 24*i* and the concave 18 are made up so as to rotatably support the first cam member 23 and the second cam member 24.

With such a supporting structure, the rotating cams 23*e* and 24*e* have peripheries thereof supported at two points, including the concave 18 disposed on the second mounting wall 16*b* and the shaft holes 23*i* an 24*i*. This does not shake rotational centers of the shafts 23*b* and 24*b* rotated via the drive motor 21, the deceleration gears 22, the drive gears 23*a* and 24*a*, thus providing stable rotational drive. This also makes stable rotations of the driver swinging pins 23*g* and 24*g*, thus providing smooth reciprocal operation for the driver 60. Also, the eccentric cams 23*c* and 24*c* arranged between the rotating cams 23*e* and 24*e* and the drive gears 23*a* and 24*a* cannot be deviated at centers, thus making smooth operation of the clinch swinging shaft 57 swung via the anvil swinging shaft 37 and the clinch swinging pints 23*d* and 24*d*.

As described above, the holder housing 15 is formed to a box shape enclosed the first mounting wall 16*a* and the second mounting wall 16*b*, and the first housing room 15*a* containing the deceleration gears 22 and the second housing room 15*b* containing the cam members 23 and 24 are separated therebetween by the bulkhead 16*c*. Such a structure provides far less noise leakage during driving, thus giving excellently quiet operation.

FIGS. 8 and 9 show another embodiment of the supporting structure for the cam members. The supporting structure in the embodiment has small rollers 23*k* and 24*k* built in the second mounting wall 16*b*. The rollers 23*k* and 24*k* are supported to contact peripheries of the rotating cams 23*e* and 24*e*. Such a supporting structure for the cam members having the rollers 23*k* and 24*k* arranged therein can make further smooth rotations of the rotating cams 23*e* and 24*e* and reduce noise further during driving.

In the above description of the supporting structure for the cam members 23 and 24 shown in FIGS. 5 through 9, the second mounting wall 16*b* having the rotating cams 23*e* and 24*e* fitted thereon and the bulkhead 16*c* are integrated in the single holder housing 15. Alternatively, separate holder housings may be formed before being combined together, which are of the first housing room 15*a* and the second housing room 15*b*.

The driver 60, as shown in FIGS. 4 through 5, is made up of the driver body 61 having a paired horizontally long right and left slits 62*a* and 62*b* of identical shape formed thereon and of a vertically long driver head 63 disposed orthogonally with the driver body 61. The driver head 63 is formed of plate material thickness of which is virtually same as the staple at a leading edge 64 thereof. The driver head 63 has a long hole 65 for engaging a staple forming member 77 (which will be described later) in a longitudinal direction at a central portion thereof and has guide plate springs 66*a* and 66*b* disposed for engaging with the staple forming member 77 to press in while driving the staple.

The driver 60 formed as described above moves the driver head 63 one reciprocal stroke while the driver swinging pins 23*g* and 24*g* fitted with the respective slits 62*a* and 62*b* of the driver body 61 rotate one turn. This completes stapling operation. The driver swinging pints 23*g* and 24*g* are symmetrically put not to deviate an acting point for the driver 60. As described above, the driver 60 features that the rotations of the rotating cams 23*e* and 24*e* arranged symmetrically make upward or downward pushing while moving the acting points in sequence, not causing the driver head 63 to displace right or left. This allows the staples to pass securely through even a large amount of sheet bundle.

The anvil unit 30, as shown in FIG. 3, is made up of an anvil 31 for pressing the sheet bundle and paired anvil arms 32*a* and 32*b* extended from respective ends of the anvil 31 for pinching both sides of the apparatus frame 11. The anvil 31 has a flat sheet pressing surface 33 and a clincher covered with a cover 34 on the sheet pressing surface 33. The anvil arms 32*a* and 32*b* are made swingable with centers of first swinging fulcrums 35*a* and 35*b* supported axially at the apparatus frame 11. It should be noted that the anvil arms 32*a* and 32*b* and the apparatus frame 11 are urged at their respective lower ends by the first spring 36*a* and 36*b* as shown in FIGS. 1 and 2 so that the anvil 31 can be placed at a position opened for the sheet table 13 to put the sheet bundle therein in normal state.

The anvil unit 30, as shown in FIGS. 2 and 3, is swung by an anvil swinging shaft 37 swung as being made to abut on surfaces of the eccentric cams 23*c* and 24*c* in the driver unit 20 and by virtually elbowed activating levers 27*a* and 27*b* made to abut on the anvil swinging shaft 37. The activating levers 27*a* and 27*b* are supported at the anvil arms 32*a* and 32*b* by second swinging fulcrums 38*a* and 38*b* and has ends thereof urged to respective edges of the anvil arms 32*a* and 32*b* by second spring 39*a* and 39*b* with engaging projects 28*a* and 28*b* made contact. For the reason, swinging of the anvil swinging shaft 37 made by rotations of the eccentric cams 23*c* and 24*c* are directly transmitted to the activating levers 27*a* and 27*b*. At the same time, the anvil arms 32*a* and 32*b* are moved up and down with centers of the first swinging fulcrums 35*a* and 35*b* to support the sheet bundle by clamping it between the anvil 31 and a sheet table. When the anvil swinging shaft 37 is made to continue swinging by rotations of the eccentric cams 23*c* and 24*c*, this prevents the anvil arms 32*a* and 32*b* clamping the sheet bundle from rotating. When the eccentric cams 23*c* and 24*c* continue rotation further, only the activating levers 27*a* and 27*b* supported at the anvil arms 32*a* and 32*b* by the second swinging fulcrums 38*a* and 38*b* resist against the second springs 39*a* and 39*b* to swing counterclockwise without change. The anvil 31 therefore can support the sheet bundle by clamping it irrespective of thickness of the sheet bundle. In this way, reactive force of the stretched second springs 39*a* and 39*b* act on the anvil arms 32*a* and 32*b* through the activating levers 27*a* and 27*b*. This allows the anvil 31 held on the anvil arms 32*a* and 32*b* to support the sheet bundle with a certain force irrespective of the sheet bundle.

The cover 34 of the anvil 31 has the clincher unit 50 disposed therein. The clincher unit 50 is an arrangement for bending edges of the staples passed through the sheet bundle by the driver head 63 inside the driver 60. The clincher unit 50, as shown in FIG. 10, is made up of paired clinchers 51*a* and 51*b* for guiding to open and close the both edges of the staples, a clinch plate 52 for pressing at centers of clinchers 51*a* and 51*b* to bend the both edges of the staples, and a U-shaped clinch arm 53 supported swingably at the first swinging fulcrums 35*a* and 35*b* of the anvil arms 32*a* and 32*b*. The clinch arm 53 is rotatably supported at the first swinging fulcrums 35*a* and 35*b* on the apparatus frame 11 together with the anvil arms 32*a* and 32*b*. After the anvil arms 32*a* and 32*b* support the sheet bundle by clamping it, the clinch arm 53 is independently swung with centers of the first swinging fulcrums 35*a* and 35*b* by joint levers 26*a* and 26*b* interlocked with the clinch swinging pins 23*d* and 24*d*. The clinch arm 53 then moves the clinch plate 52 interlocked with the clinch arm 53. The joint levers 26*a* and 26*b*, as shown in FIG. 2, are rotatably supported at the respective swinging fulcrums of the anvil arms 32*a* and 32*b* and the clinch arm 53. The joint levers serve to transmit swinging of the first cam member 23 and the second cam member 24 in the driver unit 20 to the anvil unit 30 and the clinch unit 50.

FIG. 11 shows a staple feeding arrangement 70 for sequentially feeding the band-shaped staples 43 held in the staple supply unit 40 toward the driver 60 and the clincher unit 50. The staple feeding arrangement 70 has a staple feeding lever 71 supported swingably on the apparatus frame 11 via the staple swinging shaft 73, a staple feeding pawl 72 disposed at an end of the staple feeding lever 71, and a plate spring 74 for urging the staple feeding lever 71 to a predetermined position. Feeding the band-shaped staple 43 is made by rotating the drive gears 23*a* and 24*a* with the drive motor 21. The rotation allows staple feeding pings 23*h* and 24*h* mounted to stand at the drive gears 23*a* and 24*a* pushes rightward the staple feeding lever 71 supported to resist against the plate spring 74. This hooks the staple feeding pawl 72 on the staples 43. When the drive gears 23*a* and 24*a* are rotated, further, the staple feeding pins 23*h* and 24*h* are taken out of the staple feeding lever 71, which is then pushed back leftward by force of the plate spring 74. In such an operation, the staples 43 are fed out toward a bending block 75 by the staple feeding pawl 72.

The staples 43 moved forward sequentially by the staple feeding arrangement 70, as shown in FIG. 12, are abutted against a staple catching groove of the square bending block 75 disposed at a front of the apparatus frame 11. A staple forming member 77 placed through a homer pin 76 at a long hole 65 of the driver head 63, then can form the staple 43 to U-shape as the driver head 63 moves up. After that, the both side plate springs 66*a* and 66*b* on the driver head 63 are moved on guide blocks 78*a* and 78*b*. This disengages the plate springs 66*a* and 66*b* from the staple forming member 77. Only the driver head 63 pushes up the U-shaped staple 43 onto the anvil 31 positioned further upward to pass it through the sheet bundle. The clincher unit 50 bends the both legs of the staple 43, completing the stapling operation.

FIG. 13 shows the sequential stapling operation of the stapler apparatus 10 as looked to the front thereof. The following describes operation steps in the order shown in the figure.

a. Initial State

This shows a state right before start of the stapling operation. The staple 43 is fed under the bending block 75 by the means described by reference to FIGS. 11 and 12. The sheet bundle 79 is aligned on the sheet table 13. The driver 60 is put at a home position at the bottom, while the anvil 31 is open as separated away from the sheet bundle 79.

b. Sheet Bundle Clamping State

When a stapling start signal is received in the state a above, the paired rotating cams 23*e* and 24*e* start rotation in arrow directions. With the rotations of the rotating cams 23*e* and 24*e*, the driver swinging pins 23*g* and 24*g* push the driver 60 upward, while the anvil 31 moves down to clamp the sheet bundle 79 in the sheet table 13.

c. Staple Forming State

The staple forming member 77 bends upward the both ends of the staple 43 put on the bending block 75 as interlocked with upward movement of the driver 60 in step b above.

d. Stapling Start State

The driver 60 and the staple forming member 77 are disengaged from the state at step c above. Only the driver 60 moves up. The end 64 on the driver head 63 then is butted against the U-shaped staple 43. The staple 43 is at the state right before being driven into the sheet bundle 79.

e. Stapling Setup State

When the driver 60 moves up further from the state at step d above, the both ends on the U-shaped staple 43 are passed through the sheet bundle 79 and run into the clinchers 51*a* and 51*b*, allowing clinching to start.

f. Clinching State

Finally, the clinching plate 52 is pushed down to bend the both ends of the staple inward. This ends the sequence of stapling operations.

The operations at steps a to f can be completed in a single turn of the driver swinging pins 23*g* and 24*g* made to stand on the rotating cams 23*e* and 24*e*. As described so far, the stapler apparatus 10 according to the present invention is excellently stable as the drive parts are driven by the two systems of cam members 23 and 24 of identical members. In particular, the rotating cams 23*e* and 24*e* and the driver swinging pins 23*g* and 24*g* for driving the driver 60 can perform smooth driving as they are symmetrical in shape and position.

FIG. 14 is a timing chart illustrating the sequential operations of the stapler apparatus. The sequential operations are described below by reference to FIGS. 14, 2, and 3 through 5. The drive motor 21 starts rotation as receiving the stapling start signal from an apparatus body (not shown). The drive motor 21, as shown in FIG. 4, transmits rotational torque through the deceleration gears 22 to the first cam member 23 and the second cam member 24. The first cam member 23 and the second cam member 24 start swinging of the anvil unit 30 first, which is large in amount of swinging. The sheets are clamped in a range of an amount of swing for two sheets (85 degrees of the sixth deceleration gear 22*f*) to an amount of swing for 50 sheets shown by dotted line in the figure. In the start, swinging of the anvil swinging shaft 37 butted against the eccentric cams 23*c* and 24*c* is absorbed by the second springs 39*a* and 39*b* as the anvil unit 30 clamps the sheet bundle not to swing further. The driver 60 driven by the rotating cams 23*e* and 24*e* is moved a little later after swinging of the anvil unit 30. The staple forming member 77 interlocked with the driver 60 forms the staples 43 to U-shape before the driver head 63 drives the U-shaped staple 43 in position on the sheet bundle. After driving, the clincher unit 50 is returned up first by spring force together with release of the cam members. Then the anvil unit 30 also is returned up by spring force together with release of the cam members. At the same time, also, the driver unit 20 is returned down with release of the cam members, being reset to the home position.

The embodiments described thus far have the anvil unit 30 swung to clamp the sheet bundle between it and the driver unit 20 placed in position. Alternatively, of course, the driver unit 20 can be swung, and both the driver unit 20 and the anvil unit 30 can be swung one another.

SYMBOLS

Figure 1:
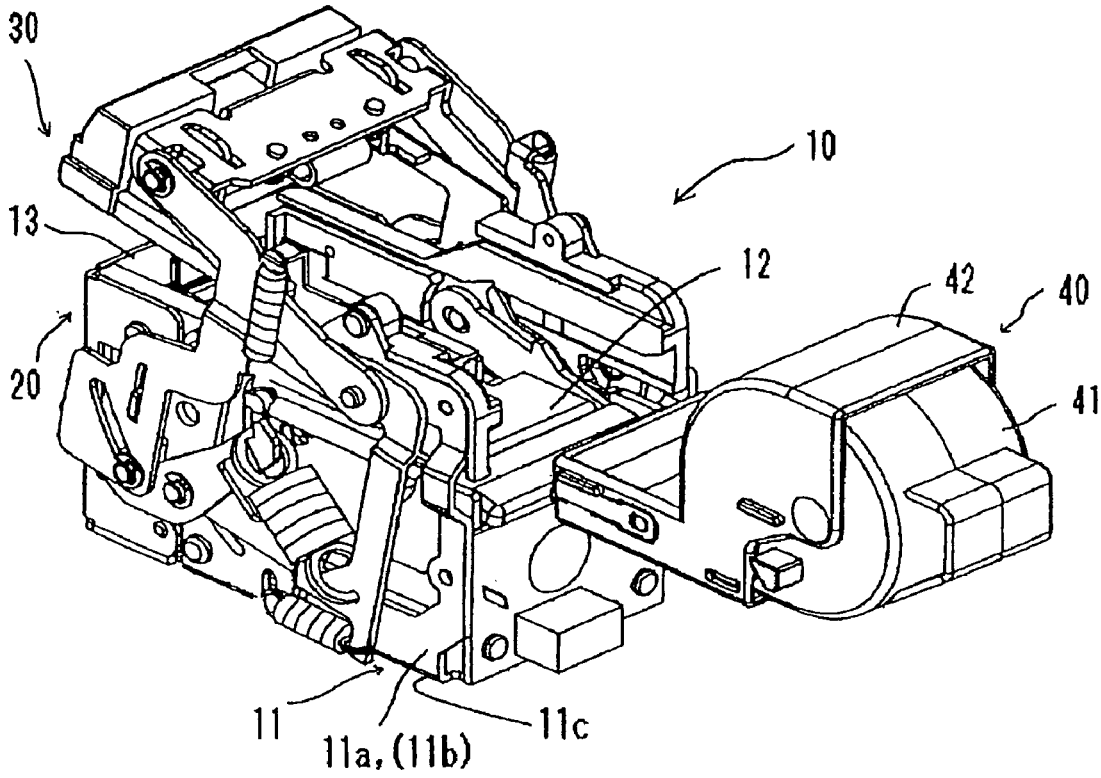
FIG. 1 is a perspective view of an overall structure of a stapler apparatus of the present invention.
Figure 2:
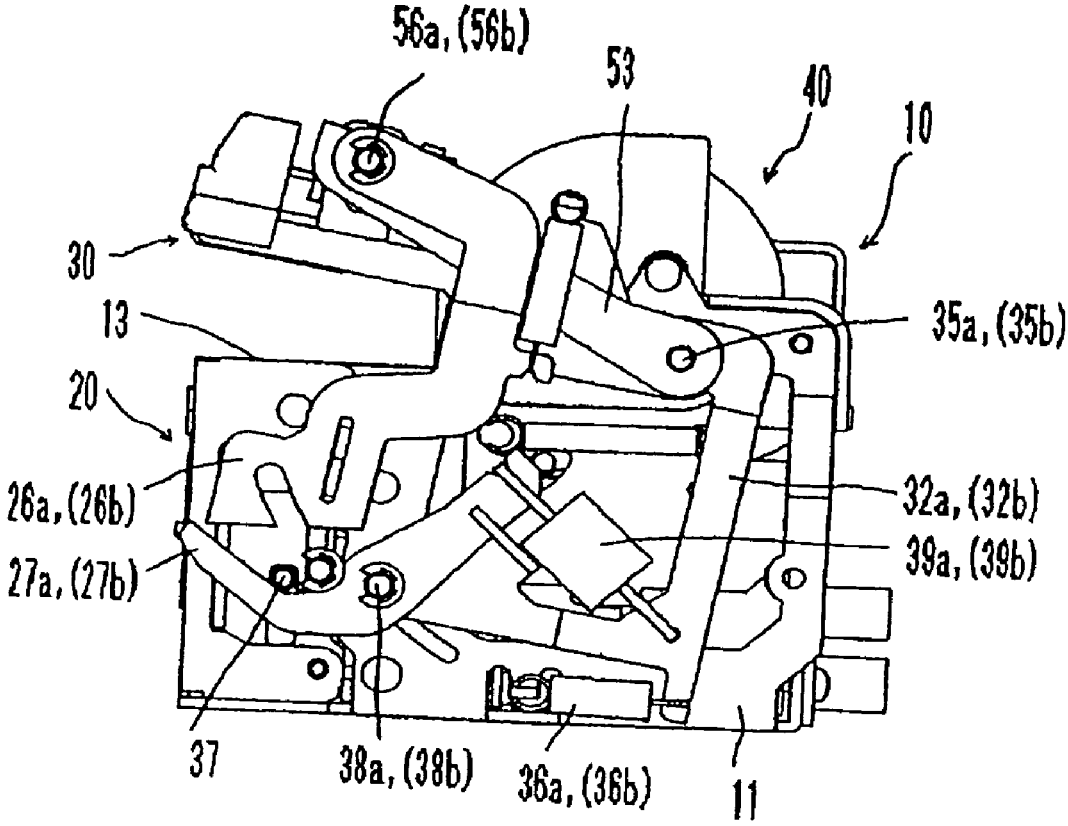
FIG. 2 is a side view of the stapler apparatus shown in FIG. 1.
Figure 3:
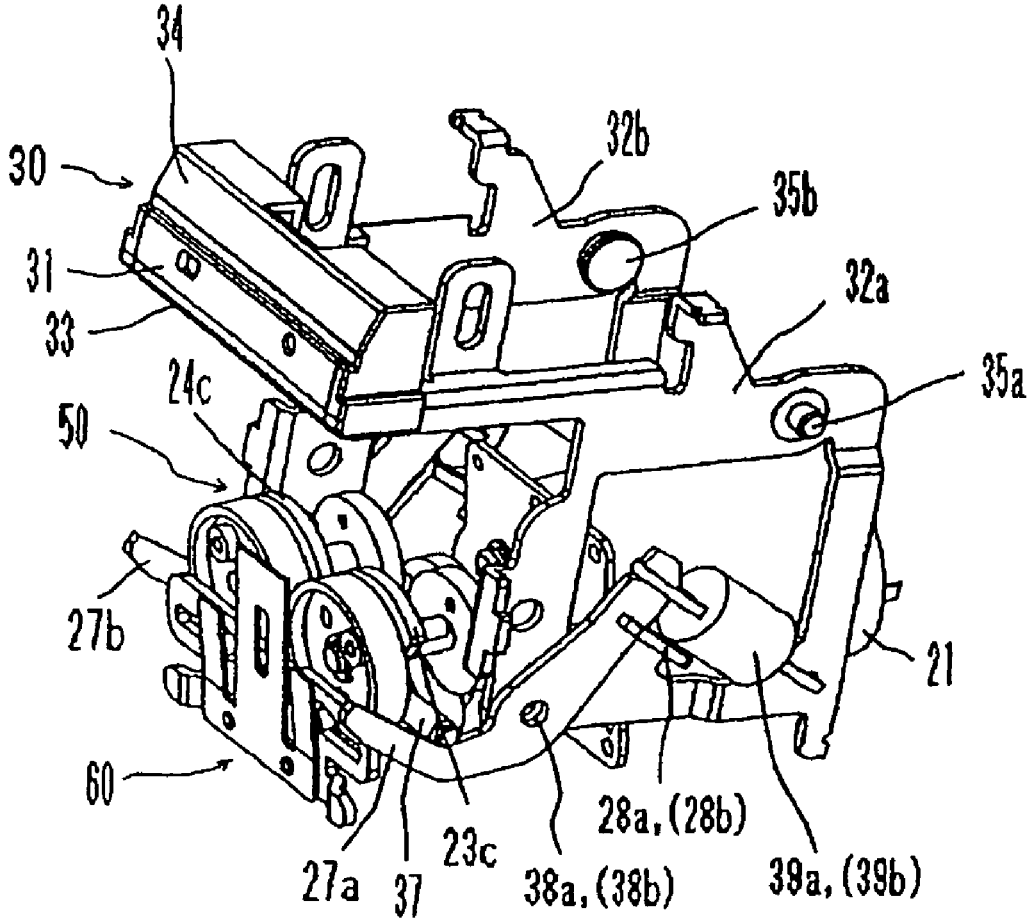
FIG. 3 is a perspective view of main units of the stapler apparatus, including a driver unit and an anvil unit.
Figure 4:
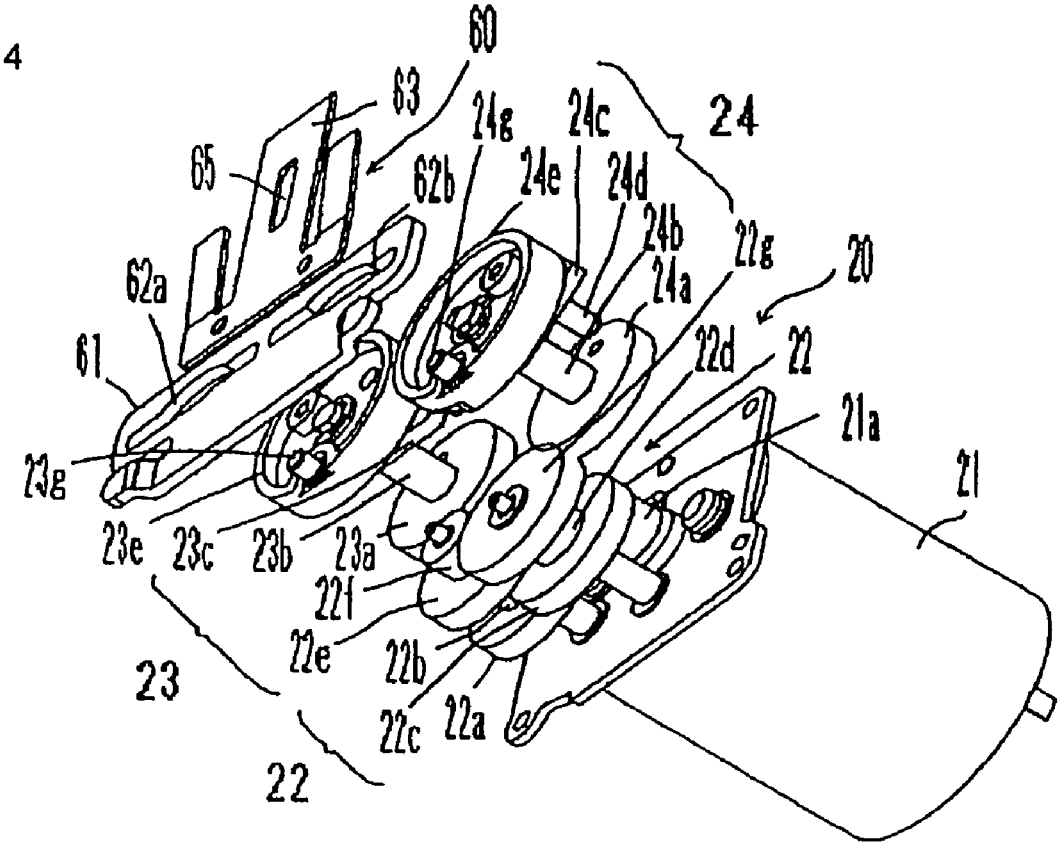
FIG. 4 is a perspective view of main parts of the driver unit.
Figure 5:
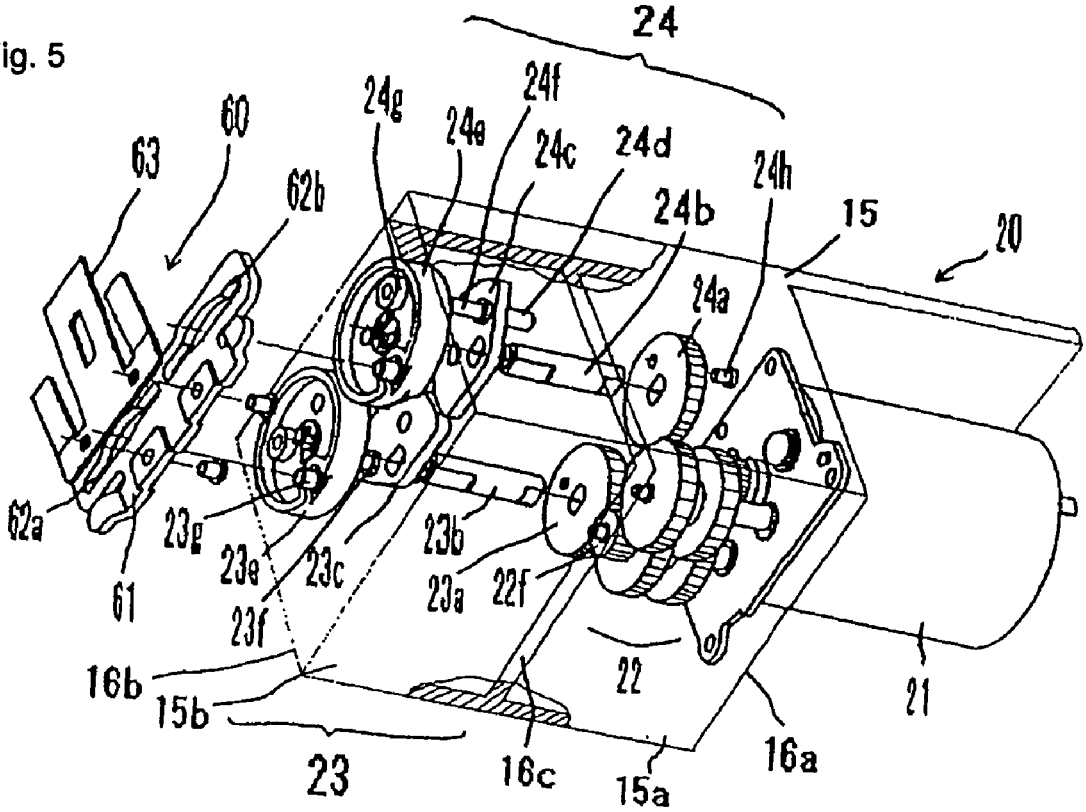
FIG. 5 is a perspective exploded view of the driver unit.
Figure 6:
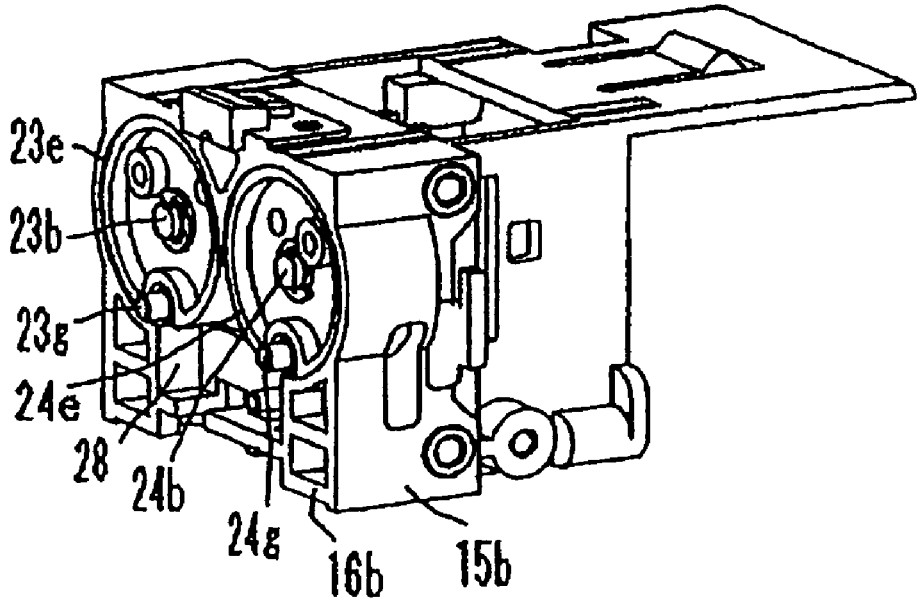
FIG. 6 is a perspective view of main parts of an embodiment of a supporting structure for cam members.
Figure 7:
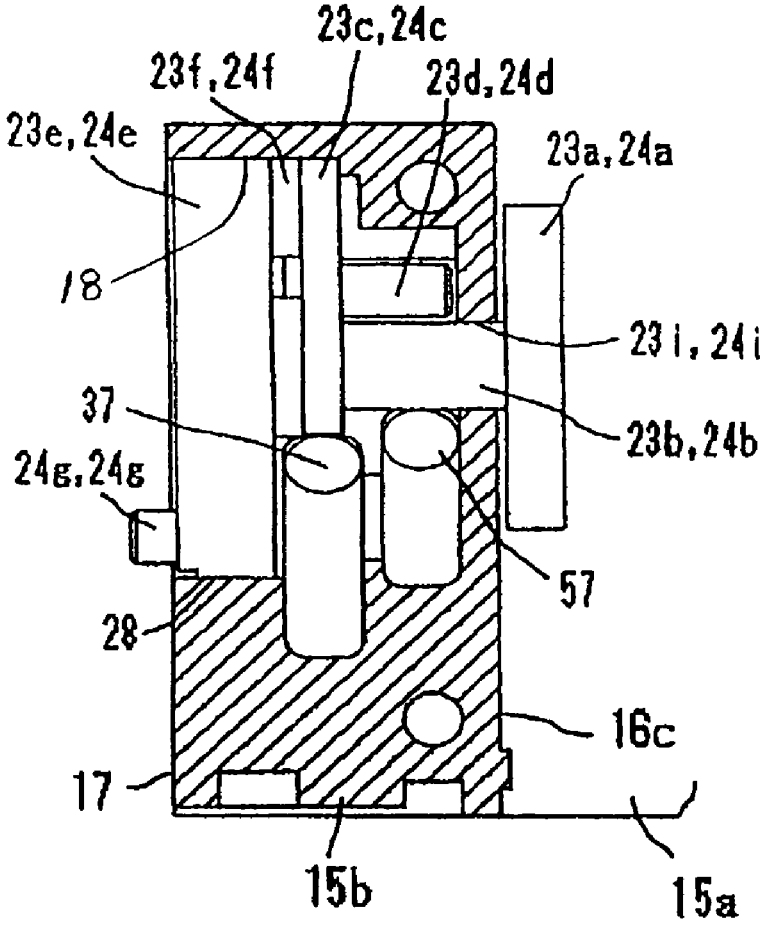
FIG. 7 is a cross sectional view of the supporting structure in FIG. 6.
Figure 8:
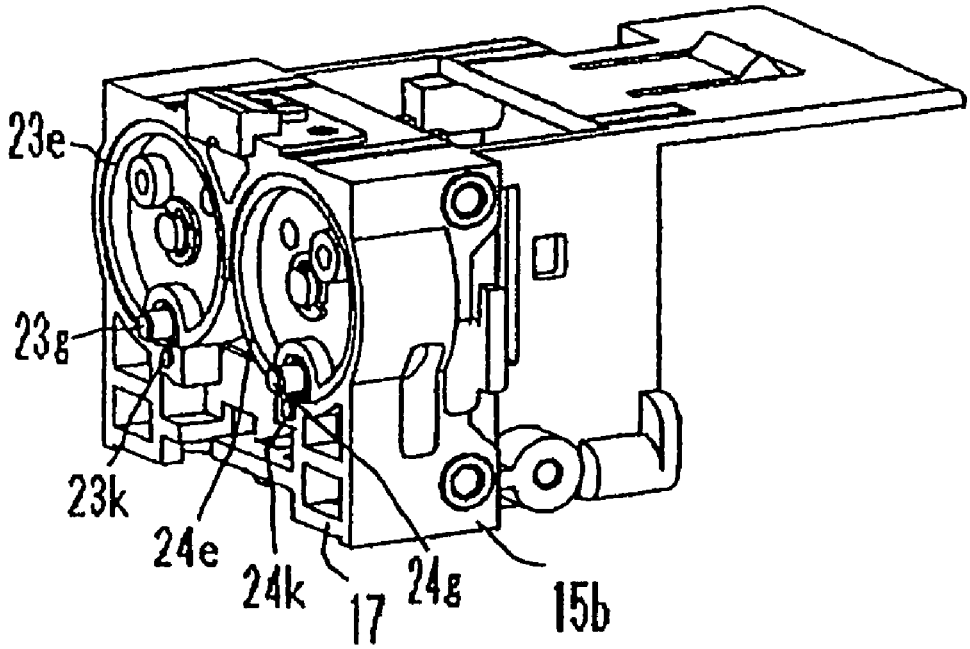
FIG. 8 is a perspective view of main parts of another embodiment of the supporting structure for the cam members.
Figure 9:
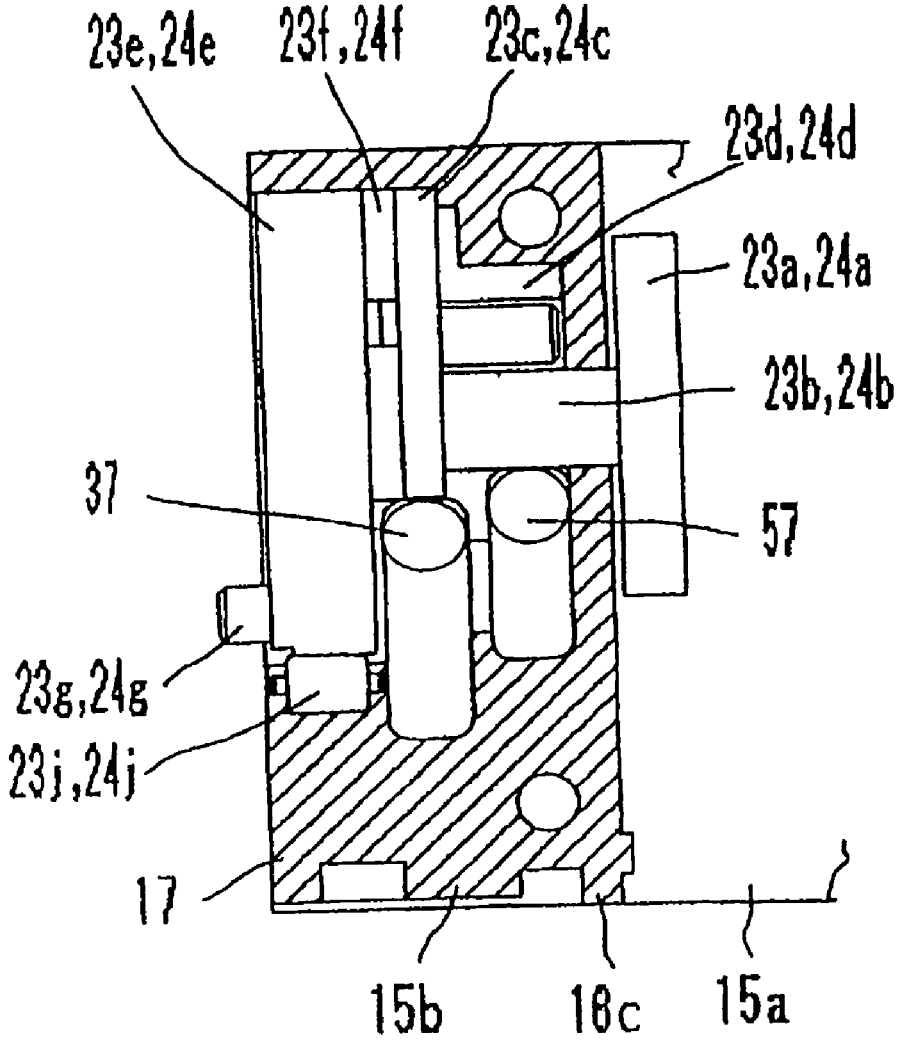
FIG. 9 is a cross-sectional view of the supporting structure in FIG. 8.
Figure 10:
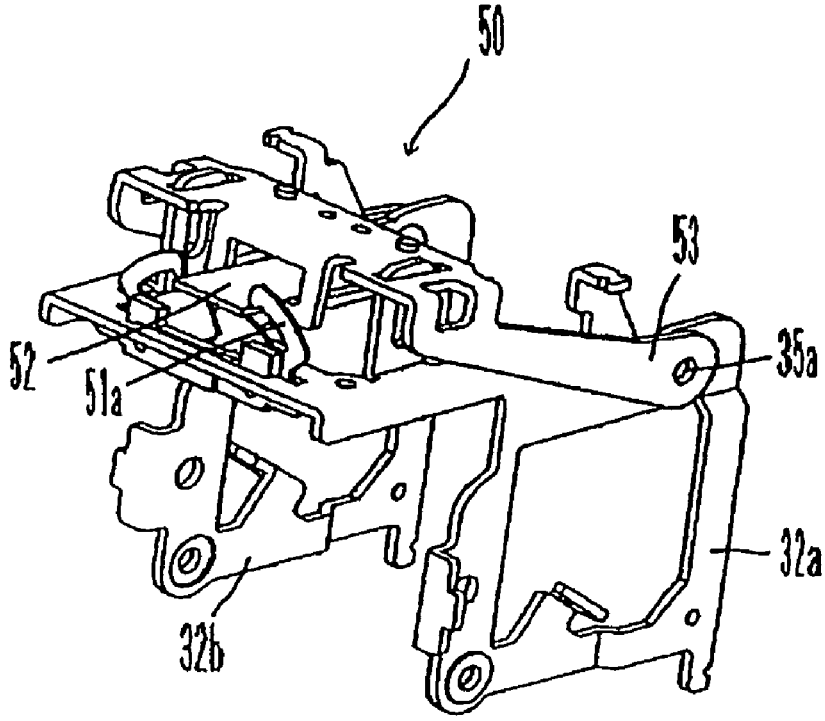
FIG. 10 is a perspective view of main parts of a clincher unit.
Figure 11:
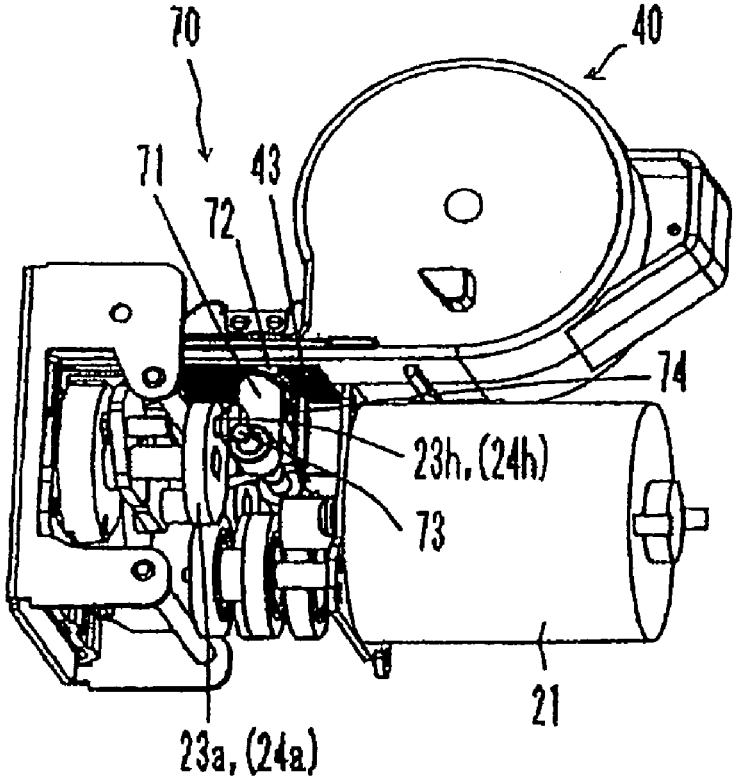
FIG. 11 is a perspective view of main parts of a staple feeding arrangement.
Figure 12:
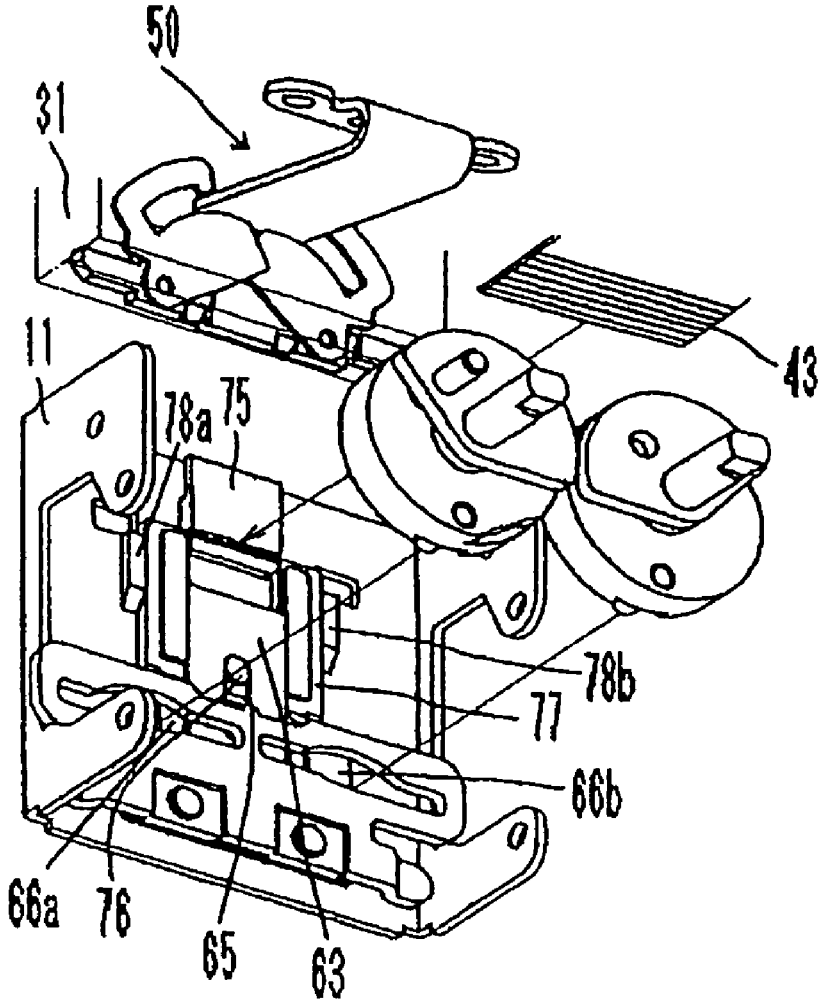
FIG. 12 is an illustration showing a forming structure of staples.
Figure 13:
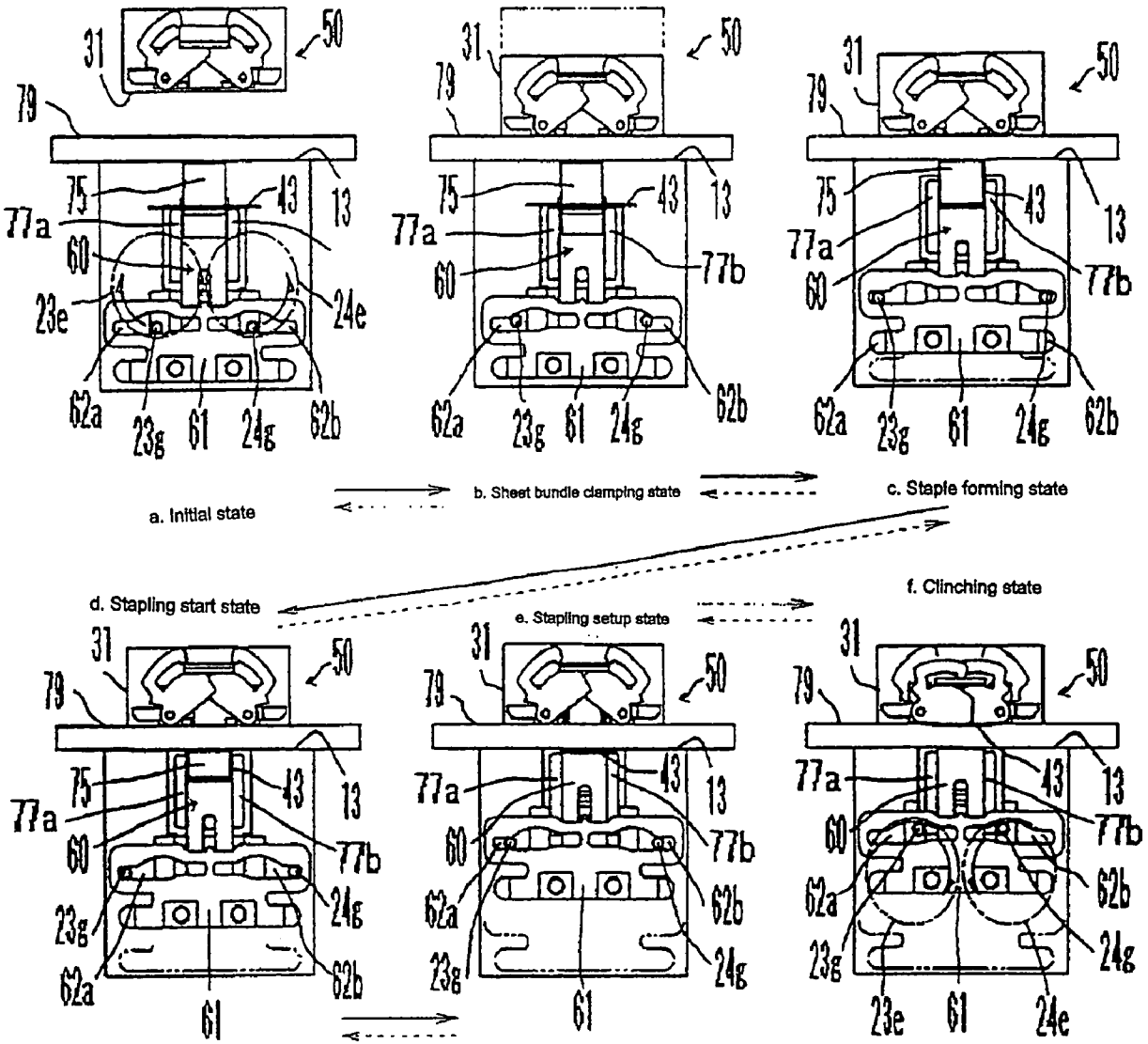
FIG. 13 is an illustration showing a sequential operation of the staples.
Figure 14:
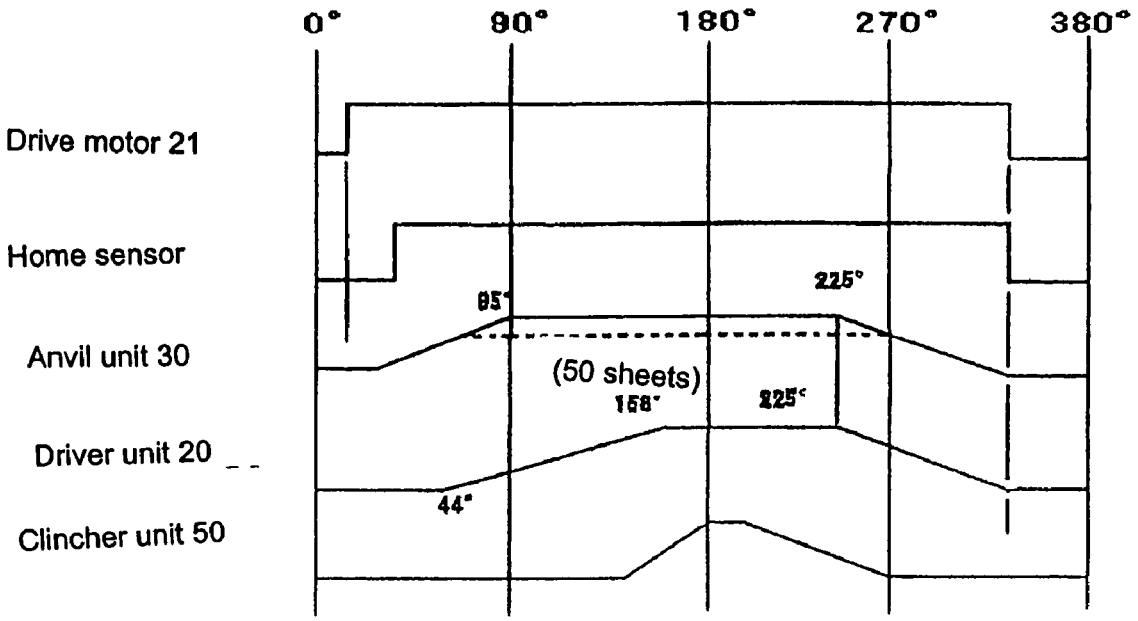
FIG. 14 is a timing chart showing the sequential operation of the staples in FIG. 11 above.

10=Stapler apparatus
15=Holder housing
16*a*=First mounting wall
16*b*=Second mounting wall
16*c*=Bulkhead
20=Driver unit
21=Drive motor
23=First cam member
23*e*=Rotating cam
23*g*=Driver swinging pin
24=Second cam member
24*e*=Rotating cam
24*g*=Driver swinging pin
30=Anvil unit
40=Staple supply unit
50=Clincher unit
60=Driver
70=Staple feeding arrangement

What is claimed is:

1. A stapler apparatus comprising right and left side frames each opposing the other, a reciprocally moving staple driving member arranged between said side frames, a cam member interlocked to said staple driving member to reciprocally move said staple driving member and a drive motor interlocked to said cam member, wherein said drive motor, said cam member and said staple driving member are arranged in order between said left and right frames;

wherein said cam member is formed of paired rotating cams, and rotating shafts of said respective rotating cams are arranged in parallel with a direction virtually orthogonalizing a plane formed by reciprocal movement locus of said staple driving member; and wherein said paired rotating cams have cam faces displacing in a reciprocal movement direction of said staple driving member with rotation, and said cam faces are fitted with said staple driving member.

2. Said stapler apparatus according to claim 1, wherein said right and left paired side frames have holder members disposed therebetween, and said holder members have said drive motor and said cam member installed thereon.

3. Said stapler apparatus according to claim 2, wherein said holder members have supports for supporting rotating shafts of said cams and supports for supporting peripheries of said cams disposed thereon, and said cams are rotatably supported at said two supports.

4. Said stapler apparatus according to claim 1, wherein said stapler apparatus includes a holder housing having a mounting wall for said drive motor and a mounting wall for said cam member, and said two mounting walls contain gears therebetween for transmitting drive force from said drive motor to said cam member.

5. Said stapler apparatus according to claim 1, wherein an anvil cam and a clinch cam are added thereto.

6. A stapler apparatus comprising:

right and left side frames each opposing the other;

a reciprocally moving staple driving member arranged between said side frames;

a cam member interlocked to said staple driving member to reciprocally move said staple driving member;

a drive motor interlocked to said cam member, wherein said drive motor, said cam member and said staple driving member are arranged in order between said left and right frames;

said stapler apparatus includes a holder housing having a mounting wall between said right and left side frames for installing thereon said drive motor and a mounting wall between said right and left side frames for installing said cam member, and said two mounting walls contain gears therebetween for transmitting drive force from said drive motor to said cam member.

7. Stapler apparatus according to claim 6, wherein said cam member is formed of rotating cams, wherein said mounting walls have two supports for supporting rotating shafts of said cams and supports for supporting peripheries of said cams disposed thereon, and said cams are rotatably supported at said two supports.

8. Said stapler apparatus according to claim 6, wherein said cam member is formed of paired rotating cams, and rotating shafts of said respective rotating cams are arranged in parallel with a direction virtually orthogonalizing a plane formed by reciprocal movement locus of said staple driving member.

9. Said stapler apparatus according to claim 8, wherein said paired rotating cams have cam faces displacing in a reciprocal movement direction of said staple driving member with rotation, and said cam faces are fitted with said staple driving member.

10. Said stapler apparatus according to claim 6, wherein an anvil cam and a clinch cam are added thereto.

* * * * *